US009816696B1

(12) United States Patent
Clifford

(10) Patent No.: US 9,816,696 B1
(45) **Date of Patent: *Nov. 14, 2017**

(54) FAN COOLED LED LIGHT AND HOUSING

(71) Applicant: LEDLab, LLC, Mesa, AZ (US)

(72) Inventor: Scott Clifford, Mesa, AZ (US)

(73) Assignee: LEDLAB, LLC, Mesa, AZ (US)

( * ) Notice: Subject to any disclaimer, the term of this patent is extended or adjusted under 35 U.S.C. 154(b) by 399 days.

This patent is subject to a terminal disclaimer.

(21) Appl. No.: 13/908,690

(22) Filed: Jun. 3, 2013

Related U.S. Application Data

(60) Provisional application No. 61/756,729, filed on Jan. 25, 2013, provisional application No. 61/802,406, filed on Mar. 16, 2013.

(51) Int. Cl.
*F21K 99/00* (2016.01)
*F21V 29/00* (2015.01)
*F21V 29/02* (2006.01)

(52) U.S. Cl.
CPC ..... *F21V 29/20* (2013.01); *F21V 29/02* (2013.01)

(58) Field of Classification Search
CPC ..... F21V 15/011; F21V 29/22; F21K 9/135
See application file for complete search history.

(56) References Cited

U.S. PATENT DOCUMENTS 8,007,143 B2 * 8/2011 Liu ..... F21V 29/004 362/218
8,517,574 B2 * 8/2013 Horng ..... F21S 8/026 362/345
2008/0285271 A1 * 11/2008 Roberge ..... F21S 8/033 362/235
2009/0268468 A1 * 10/2009 Liu ..... F21V 29/004 362/294
2010/0020537 A1 * 1/2010 He ..... F21K 9/137 362/234
2010/0127637 A1 * 5/2010 Alexander ..... F21V 15/01 315/294
2010/0172144 A1 * 7/2010 Liu ..... F21K 9/00 362/373
2010/0264799 A1 * 10/2010 Liu ..... F21V 29/006 313/46
2010/0265727 A1 * 10/2010 Liu ..... F21K 9/00 362/373
2012/0086340 A1 * 4/2012 Hashizume ..... F21V 29/673 315/112
2013/0044491 A1 * 2/2013 Chen ..... F21V 29/02 362/294

(Continued)

*Primary Examiner* — Elmito Breval
(74) *Attorney, Agent, or Firm* — Booth Udall Fuller, PLC

(57) ABSTRACT

A light emitting diode (LED) system that includes a LED, a heat sink, a fan housing, a fan, and a cover is disclosed. The heat sink is typically coupled to the LED, and the fan housing is typically coupled to the heat sink opposite the LED. The fan housing includes a fan housing aperture that extends through the fan housing and at least partially houses the fan. A cover may be coupled to the fan housing opposite the heat sink. The system may include at least one air intake opening and at least one air exhaust opening. When activated, the fan may external air into the fan housing through the air intake opening and direct the air toward the heat sink and ultimately through the air exhaust opening. In so doing, the temperature of the heat sink and the LED is reduced.

16 Claims, 8 Drawing Sheets

(56) References Cited

U.S. PATENT DOCUMENTS

| | | | | |
|---|---|---|---|---|
| 2013/0094226 | A1* | 4/2013 | Huang | F21K 9/137 362/373 |
| 2013/0120973 | A1* | 5/2013 | Chen | F21V 29/2287 362/147 |
| 2013/0249375 | A1* | 9/2013 | Panagotacos | H05B 33/0803 313/13 |

* cited by examiner

FAN COOLED LED LIGHT AND HOUSING

CROSS REFERENCE TO RELATED APPLICATIONS

This document claims the benefit of the filing date of U.S. Provisional Patent Application 61/756,729, entitled "FAN COOLED LED LIGHT, HOUSING, AND POWER SUPPLY CIRCUIT" to Clifford which was filed on Jan. 25, 2013 and of the filing date of U.S. Provisional Patent Application 61/802,406 entitled "FAN COOLED LED LIGHT AND HOUSING" to Clifford which was filed on Mar. 19, 2013, the contents of which are both hereby incorporated by reference.

BACKGROUND

1. Technical Field

Aspects of this document relate generally to light emitting diode assemblies.

2. Background Art

Light-emitting diodes (LED) are becoming an increasingly popular light source. Generally, LEDs are advantageous to typical incandescent light sources due to LEDs' lower energy consumption, longer lifetime, smaller size, and faster switching. The efficiency and operational life of LEDs, however, is somewhat limited by the heat generated by LEDs with the LEDs activated.

SUMMARY

A first aspect of a light emitting diode (LED) lighting system comprises one or more LEDs, a heat sink, a fan housing, a fan, and a cover. The heat sink may be coupled to the one or more LEDs. The fan housing may be coupled to the heat sink opposite the one or more LEDs, and comprise a fan housing aperture extending there through. The fan may be coupled to the fan housing and positioned at least partially within the fan housing aperture. The cover may be coupled to the fan housing opposite the heat sink.

In particular implementations and embodiments, the LED lighting system may comprises one or more of the following. The heat sink may comprise a platform, a sink wall at least partially surrounding the platform, and an annular opening positioned between the platform and the sink wall and in fluid communication with the fan housing aperture. The heat sink may further comprise a raised center member protruding from the platform toward the fan housing, an array of ribs extending from the raised center member across the annular opening to the sink wall, at least one sink lip extending outwardly from the sink wall, and at least one fastener mount extending from the sink wall proximate the at least one sink lip. The fan housing may comprise a sloped body at least partially surrounding the fan housing aperture and abutting the sink wall, a fan housing wall coupled to the sloped body, and at least one outer opening positioned between the sloped body and the fan housing wall. The sloped wall may be substantially conical and the fan housing wall may comprise two opposing concave portions that intersect the sloped body and two opposing convex portions, and the at least one intake opening may comprise two intake openings each positioned between the sloped body and a different convex portion of the opposing convex portions. The at least one sink lip may comprise two opposing sink lips and the at least one fastener mount may comprise two opposing fastener mounts, each fastener mount extending from the sink wall proximate a different sink lip, the two opposing convex portions of the fan housing wall being aligned with the two opposing sink lips and adjacent to the two opposing fastener mounts such that an intake opening that is in fluid communication with the outer opening of the fan housing and the fan housing aperture is formed between each convex portion and each sink lip. The LED lighting system may further comprise an adapter coupled to the cover opposite the fan housing. The adapter may be removably coupled to the cover between opposing cover walls and electrically coupled to the fan. The fan housing may further comprise a fan mount positioned within the sloped body and a cylindrical rim on an end of the sloped body, and the ribs comprise arced ribs. A J-box coupled to the LED and at least partially housing the heat sink, the fan housing, and the cover, the adapter further comprising a removable wi-fi module.

In another aspect, a LED cooling assembly comprises a heat sink, a fan housing, and a fan. The fan housing may be coupled to the heat sink and comprise a fan housing aperture extending therethrough. The fan may be coupled to the fan housing and positioned at least partially within the fan housing aperture.

In particular implementations and embodiments, the LED cooling assembly comprises one or more of the following. The heat sink may comprise a platform, a sink wall at least partially surrounding the platform, and an annular opening positioned between the platform and the sink wall and in fluid communication with the fan housing aperture. The heat sink may further comprise a raised center member protruding from the platform toward the fan housing, an array of arced ribs extending from the raised center member across the annular opening to the sink wall, two opposing sink lips extending outwardly from the sink wall, and two fastener mounts extending from the sink wall each proximate a different sink lip of the two sink lips. The fan housing may comprise a sloped body at least partially surrounding the fan housing aperture and abutting the sink wall, a fan housing wall coupled to the sloped body, and at least one outer opening positioned between the sloped body and the fan housing wall. The fan housing wall may comprise two opposing concave portions that intersect the sloped body and two opposing convex portions, the at least one intake opening may comprise two intake openings each positioned between the sloped body and a different convex portion of the opposing convex portions, and the two opposing convex portions of the fan housing wall may be aligned with the two opposing sink lips and adjacent to the two opposing fastener mounts such that an intake opening that is in fluid communication with the outer opening of the fan housing and the fan housing aperture is formed between each convex portion and each sink lip. A cover coupled to the fan housing opposite the heat sink and an adapter removably coupled to the cover opposite the fan housing.

According to another aspect, a method of cooling a LED, comprises coupling a fan housing to the LED, positioning a fan within a fan housing aperture of the fan housing coupled to the LED, the fan being in fluid communication with the LED and air outside the fan housing, and activating the fan.

In particular embodiments and implementations, the method of cooling a LED may comprise one or more of the following. Positioning the fan within the fan housing aperture may comprise positioning the fan within the fan housing aperture of a sloped body of the fan housing, the fan being in fluid communication with two opposing outer openings in fluid communication with air outside the fan housing, the two opposing outer openings positioned between the sloped body and a fan housing wall coupled to the sloped body.

Coupling a heat sink to the LED between the LED and the fan housing, the heat sink comprising an annular opening in fluid communication with the LED and the fan, a sink wall surrounding the annular opening, at least one sink lip, at least one sink lip, and at least one fastener mount extending from the sink wall, wherein at least one intake opening in fluid communication with air outside the fan housing and the at least one outer opening is formed between the at least one lip and the fan housing wall. Removably coupling an adapter to a cover coupled to the fan housing opposite the LED.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended light emitting diode (LED) cooling system and/or assembly procedures for a LED cooling system will become apparent for use with implementations of LED cooling systems from this disclosure. Accordingly, for example, although particular LEDs, heat sinks, fan housings, covers, boxes, adapters, and the like are disclosed, such LEDs, heat sinks, fan housings, covers, boxes, and adapters and implementing components may comprise any shape, size, style, type, model, version, measurement, concentration, material, quantity, and/or the like as is known in the art for such LED cooling assemblies and implementing components, consistent with the intended operation of an LED cooling assembly.

LEDs are source of light gaining popularity throughout the country and the world largely due to the LED typically consuming less energy and lasting longer. While some LEDs may also manage heat better than previous sources of light, it is well known that previous LEDs still become hot, thus lessening efficiency or resulting in a safety hazard. Embodiments of the cooling systems and assemblies disclosed herein provide a fan 7 to assist in cooling the LED, as well as configurations for efficient cool of the LED and elements associated with the LED assembly.

Figure 1:
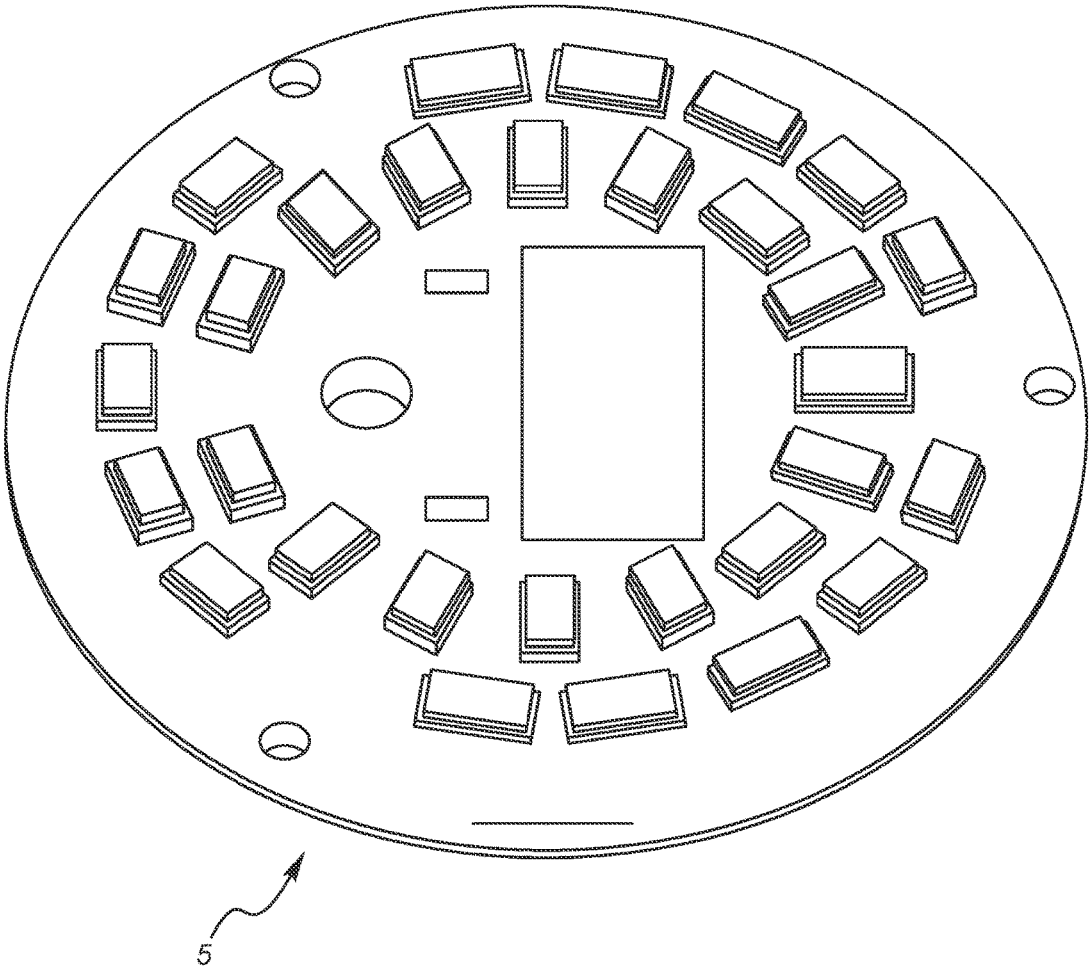
FIG. 1 is a perspective view of an exemplary light emitting diode (LED) circuit.

One of more embodiments of a LED cooling system 100, 200 comprise an LED 5. FIG. 1 illustrates exemplary an embodiment of an LED 5 utilized in a LED cooling system 100, 200, the LED 5 requiring a 120 volt or appropriate input. It is contemplated, however, that in other embodiments, any LED known in the art may be substituted or modified for use in embodiments of an LED cooling system 100 disclosed herein.

Figure 2:
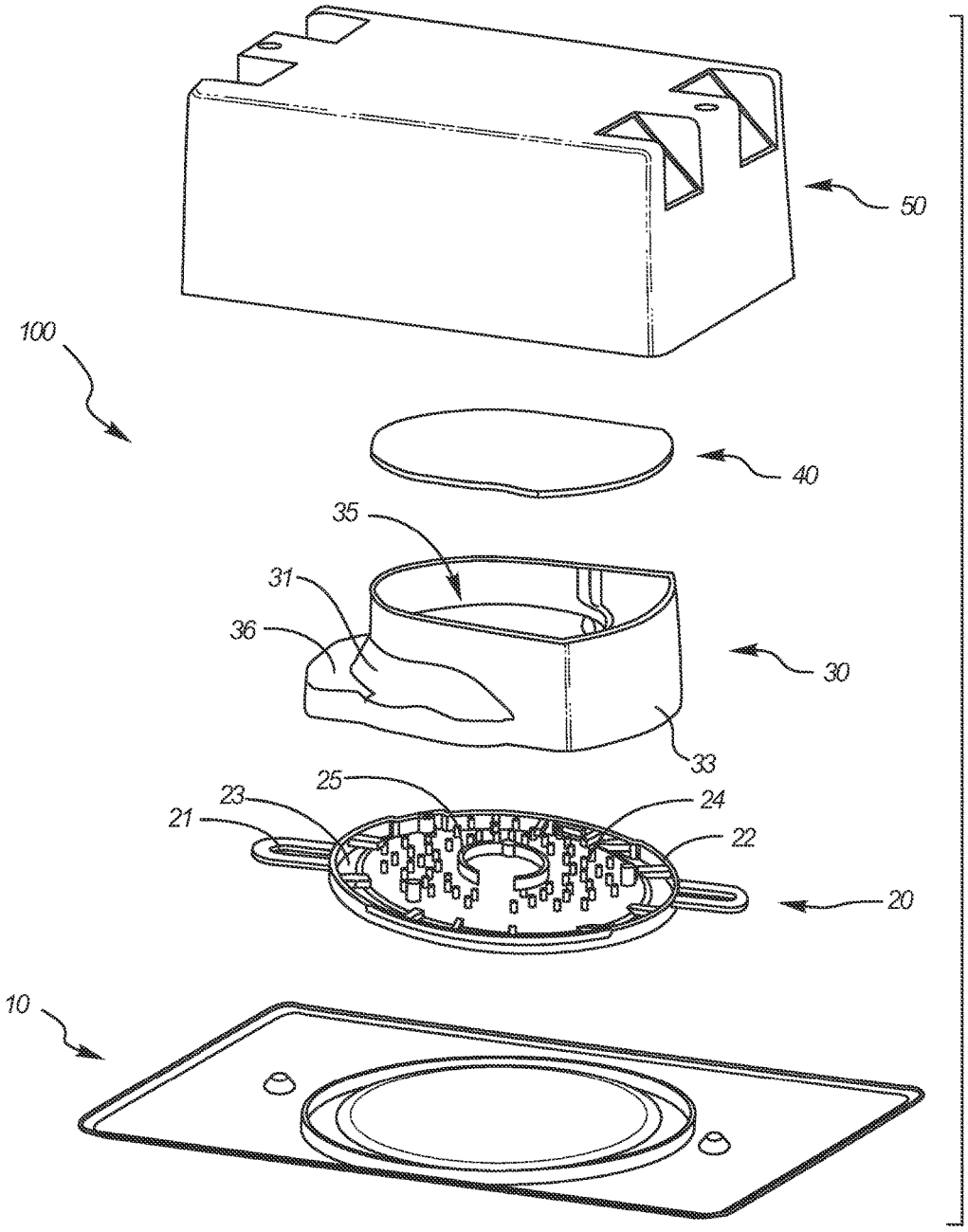
FIG. 2 is a break apart view of a first embodiment of a LED cooling system.

FIG. 2 illustrates an exploded perspective view of one exemplary embodiment of a LED cooling system comprising an cover plate 10 that includes LED 5, a heat sink 20, a fan housing 30, a cover 40, and an electrical junction box 50 (sometimes called a J-Box in the relevant industry). In some applications of the various embodiments shown herein, the electrical junction box 50 may or may not be used, and, alternatively, the housing 30 and/or cover 40 may not be used. Electrical junction boxes 50, come in standard depths including, but not limited to, 1", 2" and 3". In particular implementations, the LED 5, heat sink 20, fan housing 30 and cover 40 may all fit within even a 1" electrical junction box 50. Although not shown in FIG. 2, a fan 7 may also be nesting at least partially within the fan housing 30. As shown in greater detail in FIG. 3, a particular embodiment of the heat sink 20 is substantially circular in shape. Other embodiments of the heat sink 20, however, may comprise other shapes to correspond to the shape of the fan housing 30, as shall be described.

Figure 4:
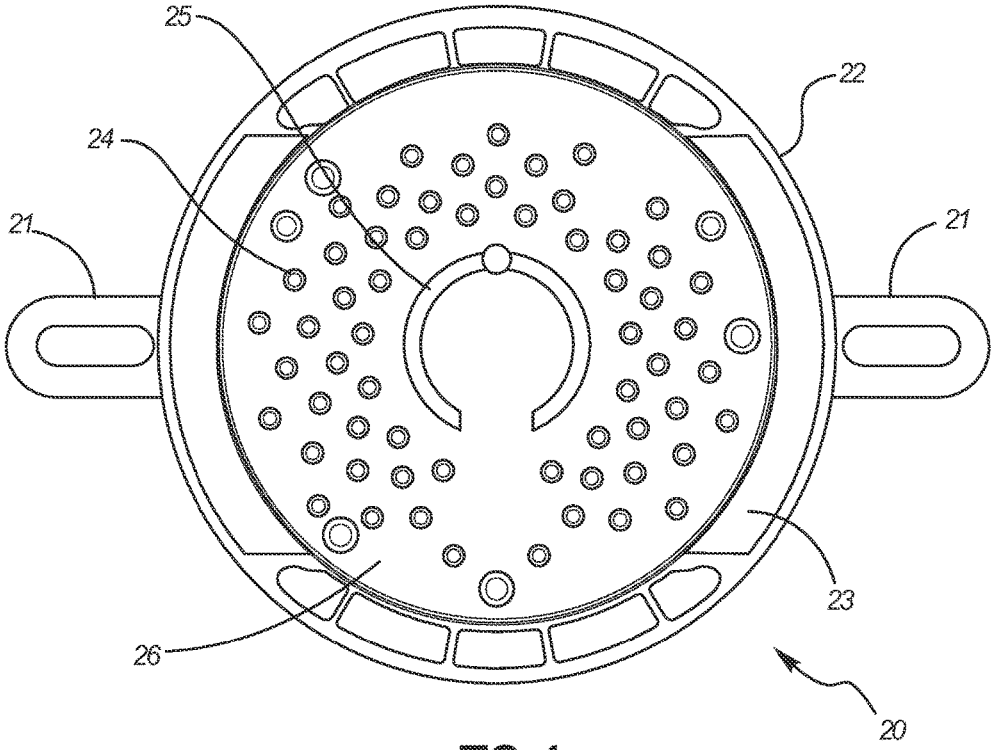
FIG. 4 is a top view of a first embodiment of a heat sink.

One or more embodiments of the heat sink 20 comprise a circular platform 26 at least partially surrounded by an annular opening 23. In embodiments wherein the platform 26 comprises a non-circular shape, the annular opening 23 comprises a shape corresponding to the shape of the platform 26. Embodiments of the platform 26 comprise one or more dividers 24 or spacers. The dividers 24 typically comprise posts or other protrusions extending from one side of the platform 26. Ideally, the dividers 24 may be positioned to assist in distributing airflow from the fan 7 in a substantially uniform manner, thus improving heat dissipation. FIG. 4 illustrates one exemplary arrangement of the dividers 24 on the platform 26. It should be recognized that other embodiments of the heat sink 20 may comprise fewer or greater dividers 24 positioned in other arrangements without departing from the scope of this disclosure. One or more embodiments of the heat sink 20 further comprise a raised center lip 25 or member which may provide support or positioning for the fan 7. In other embodiments, a thermal switch may replace the raised center lip 25.

One or more embodiments of the heat sink 20 also comprise a sink wall 22 positioned about the platform 26. The annular opening 23 typically separates at least a portion or all of the platform 26 from the sink wall 22. In embodiments wherein the annular opening 23 separates the platform from the sink wall 22, one or more connectors may bridge across the annular opening to couple the platform 26 to the sink wall 22. One or more embodiments also may comprise at least one fastener mount 21, typically positioned as two opposing fastener mounts extending from opposing sides of the sink wall 22. In other embodiments, the fastener mounts may be positioned on or extend from the platform 26.

Figure 5A:
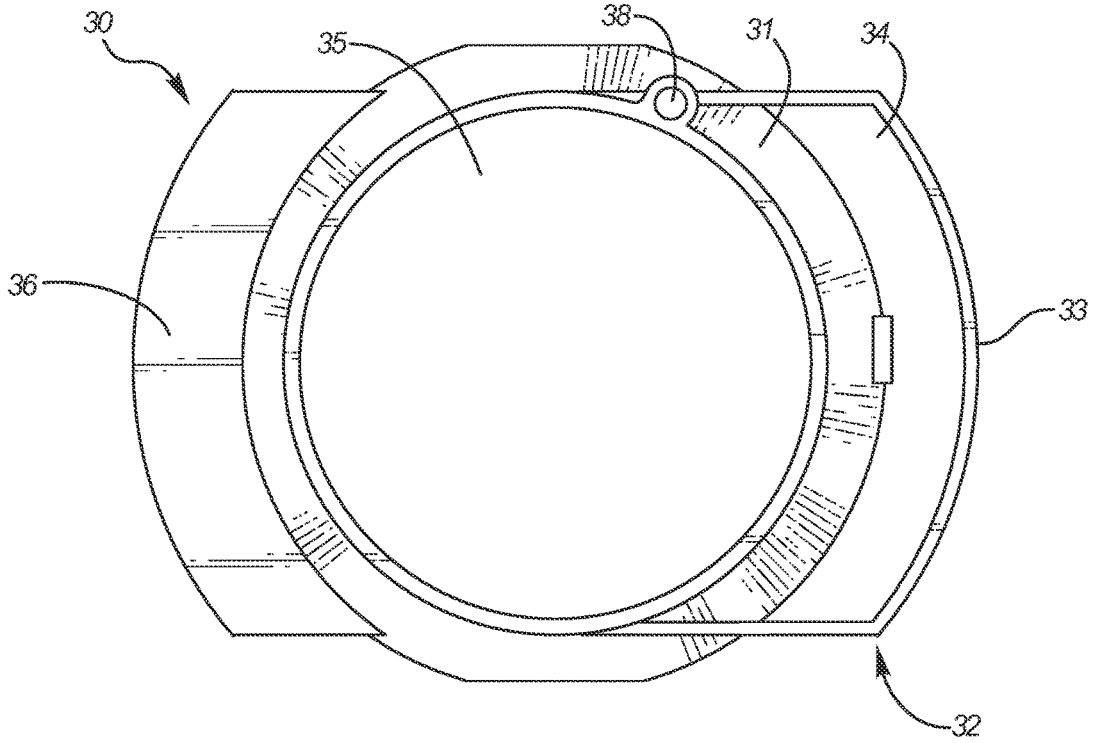
FIG. 5A a top view of a first embodiment of a fan housing.
Figure 5B:
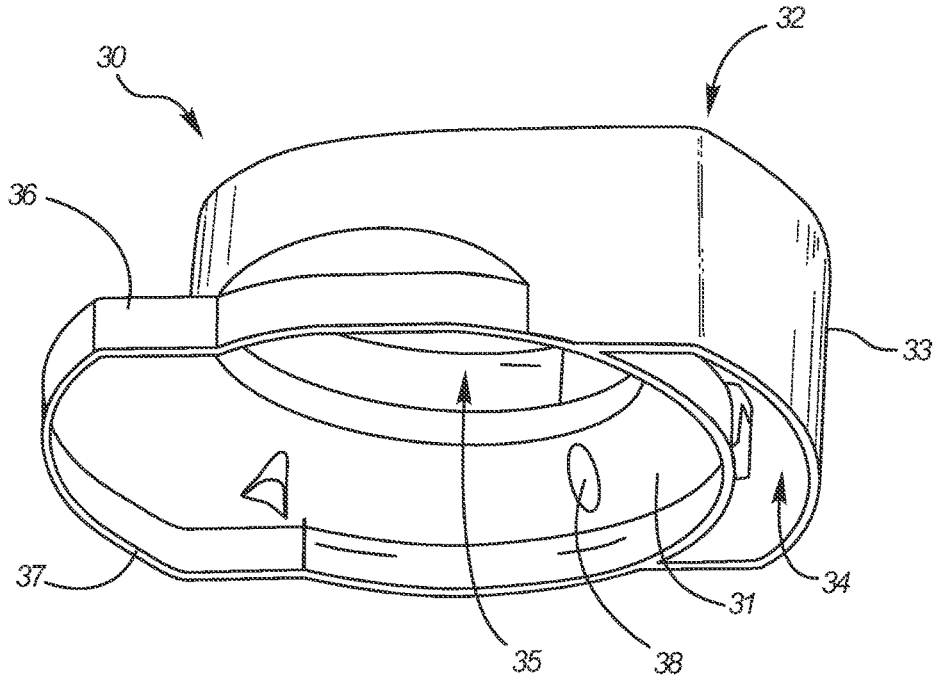
FIG. 5B is a bottom perspective view of a first embodiment of a fan housing.

FIGS. 5A and 5B illustrate an embodiment of a fan housing 30. At least a portion of the fan housing 30 is typically shaped to complement at least a portion of the heat sink 20. For example, in the embodiment of the fan housing 30 illustrated in FIGS. 5A and 5B, the fan housing 30 comprises a substantially conical sloped body 31 with a based sized equal or substantially equal to the platform 26. In some embodiments, the base of the sloped body 31 may be sized equal or substantially equal to the sink wall 22 to provide different air intakes. Although the sloped body 31 is shown as a conical sloped body 31 in FIGS. 5A and 5B, other shaped sloped bodies are also contemplated, such as but not limited to a pyramid sloped body.

One or more embodiments of a fan housing 30 also comprise a fan housing wall 32. The fan housing wall 32 typically comprises at least one convex portion. In the embodiment shown in FIG. 5B, the fan housing wall 32 comprises an open convex portion 33 separated at least partially from the sloped body 31 by an outer opening 34. Opposite the open convex portion 33 is an enclosed convex portion 36. The enclosed convex portion 36 may comprise a height substantially equally to the height of the open convex portion 33 or alternatively, as shown in the exemplary embodiment of FIG. 5B, a height substantially equal to a base rim 37 extending from a portion of a base end of the sloped body 31. In the latter, the fan housing wall 32 may comprise a convex portion 33 and a U-shaped portion. In other embodiments, the convex portion may comprise a flat portion that still provides and outer opening 34 between the wall 33 and the sloped body.

The fan housing 30 further comprises a fan housing aperture 35 extending through the fan housing 30. The fan housing aperture 35 is in fluid communication with the outer opening 34, even when the cover 40 is coupled to a top end of the fan housing 30. As such, the fan housing wall 32 typically comprises a height greater than the height of the sloped body 31 within the fan housing 30. In one or more embodiments, the fan housing aperture 35 is at least partially formed by the boundaries of the sloped body 31 and the base rim 37. A wire hole 38 is also positioned to extending through a portion of the sloped body 31 in one or more embodiments.

Figure 3:
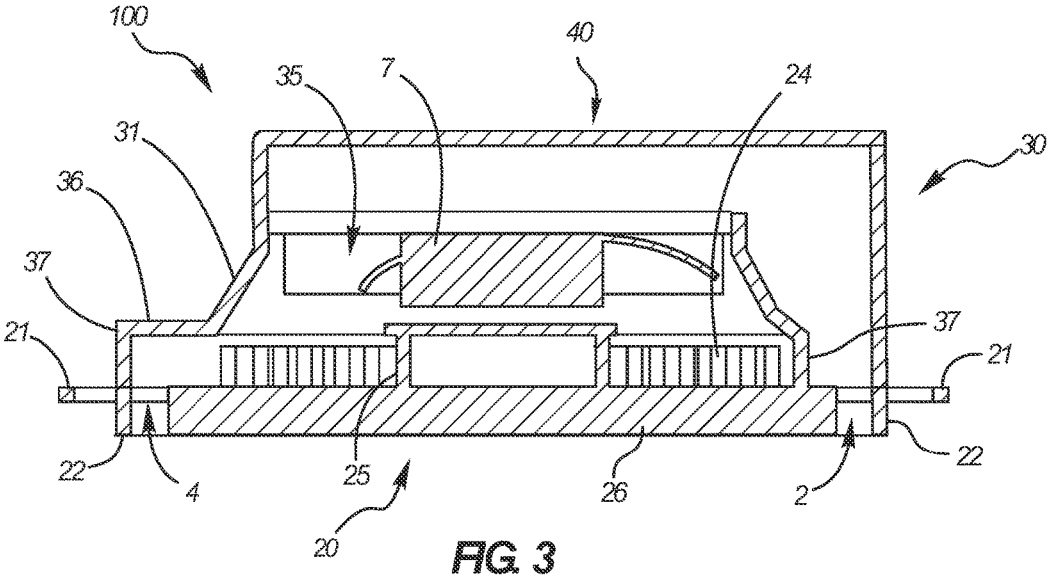
FIG. 3 is a cross sectional view of a first embodiment of a LED cooling system.

FIG. 3 illustrates a cross-sectioned view of an embodiment of a portion of an LED cooling system 100. Although not shown in FIG. 3, the LED 5 and/or cover plate 10 are typically positioned or coupled beneath the platform 26. As shown, portions of the fan housing 30 and the heat sink 20 abut one another when coupled together. For example, the open convex portion 33 of the fan housing wall 32 typically abuts a portion of the sink wall 22, and a portion of the enclosed convex portion 36 abuts another portion of the sink wall 22. When coupled in such an alignment, the outer opening 34 aligns with and is in fluid communication with a first portion of the annular opening 23, and the chamber or opening within the enclosed convex portion 36 aligns with and is in fluid communication with a second portion of the annular opening 23. A cover 40 is typically coupled to the fan housing wall 32 to cover the top of the fan housing wall 32.

The fan 7 is typically coupled to either the sloped body 31 or the raised center lip 25. When activated, the fan 7 draws air in through the air intake opening 2 formed by the first portion of the annular opening 23. Because the fan housing aperture 35, the outer opening 34, and the first portion of the annular opening are all in fluid communication with one another, activation of the fan 7 and the subsequent drawing of external air into the air intake 2 results in at least a portion of the external air being drawn into the fan housing 30 to the fan 7. The air is then dispersed by the fan 7 toward the platform 26. Because the second portion of the annular opening 23 is in fluid communication with the chamber of the enclosed convex portion 36, which is in fluid communication with the fan housing aperture 35, air within the sloped body 31 exhausts through the air exhaust opening 4 when the fan 7 is activate. By drawing external air into the sloped body 31 and blowing the air onto the platform 26 of the heat sink 20 before the air is ultimately exhausted, the overall temperature of the system 100, and particularly the heat sink 20 and the LED 5 is decreased.

A electrical junction box (J-box) 50 may also be included in one or more embodiments of an LED cooling system 100, 200. The J-box 50 is typically sized to house at least a portion of the heat sink 20, 70, the fan housing 30, 80, the cover 40, 90, and the adapter 60. In one or more embodiments, the J-box 60 couples to the face plate 10. When coupled to the face plate 10, the J-box is positioned to abut the face plate 10 with a base of the J-box 50 or leave a gap or space between the base of the J-box 50 and the LED plate. Various embodiments of the LED cooling system 100, 200 are configured to fit within a standard electrical junction box typically offered in the housing industry. In some embodiments, the base of the J-box 50 abuts or is in direct contact with the plate 10, and air is drawn into and exhausted from the LED cooling system 100, 200 through an annular opening on the face plate 10. The J-box 50 may be utilized to hold the heat sink 20, 70, the fan housing 30, 80, and the cover 40, 90 together. Alternatively or additionally, various couplings known to a person having skill in the art may utilize to couple the heat sink 20, 70, the fan housing 30, 80, and the cover 40, 90 together, such as but not limit to screws, pins, adhesives, and the like.

Figure 6:
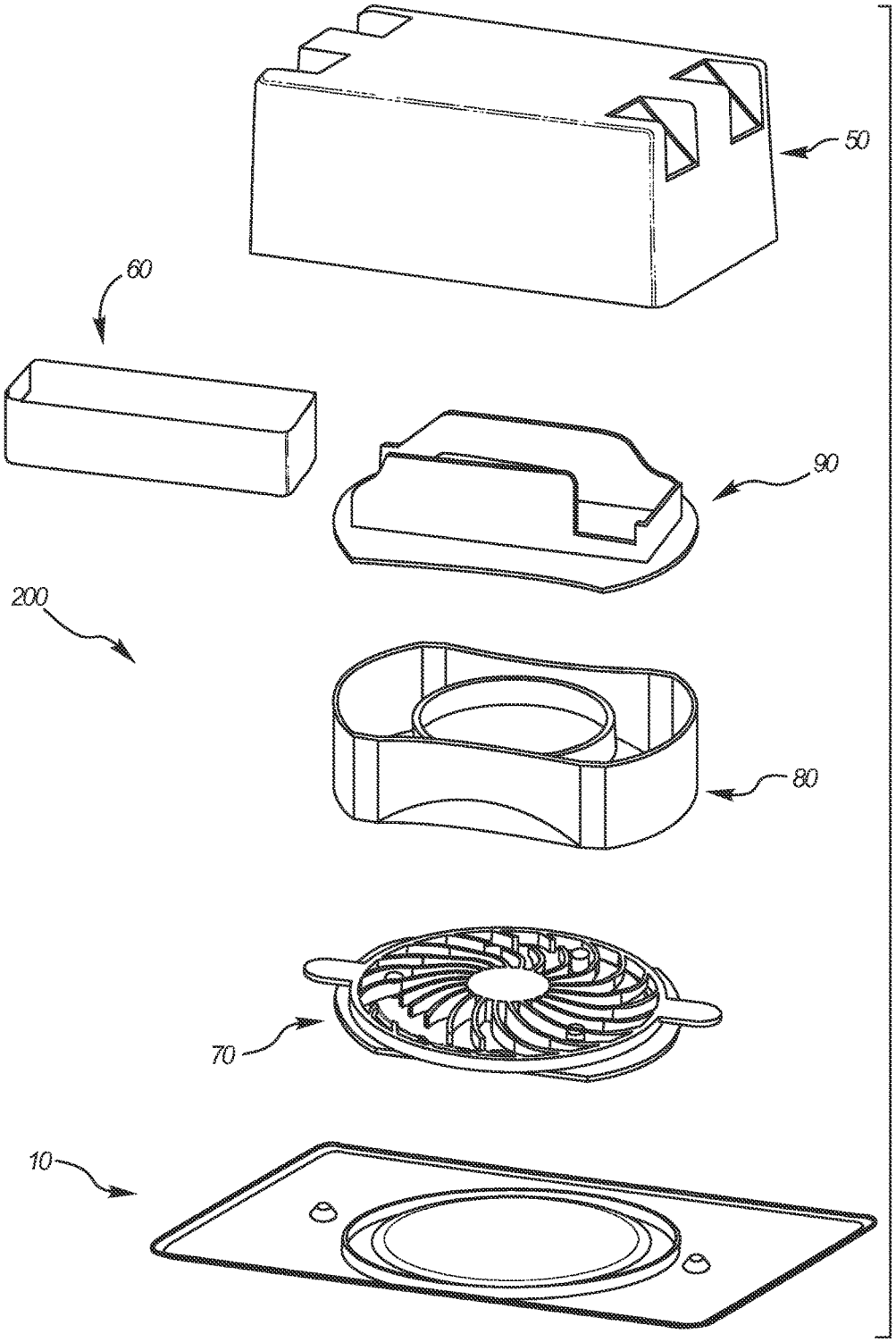
FIG. 6 is a break apart view of a second embodiment of a LED cooling system.

FIG. 6 illustrates another embodiment of an LED cooling system 200. Similar to LED cooling system 100, the LED cooling system 200 shown in an exploded view in FIG. 6 comprises an face plate 10, LED 5, and J-box 50 as previously described. The LED cooling system 200 also comprises a heat sink 70, a fan housing 80, and cover 90, although the configuration of these varies from the configuration of LED cooling system 100 as described below.

Figure 7:
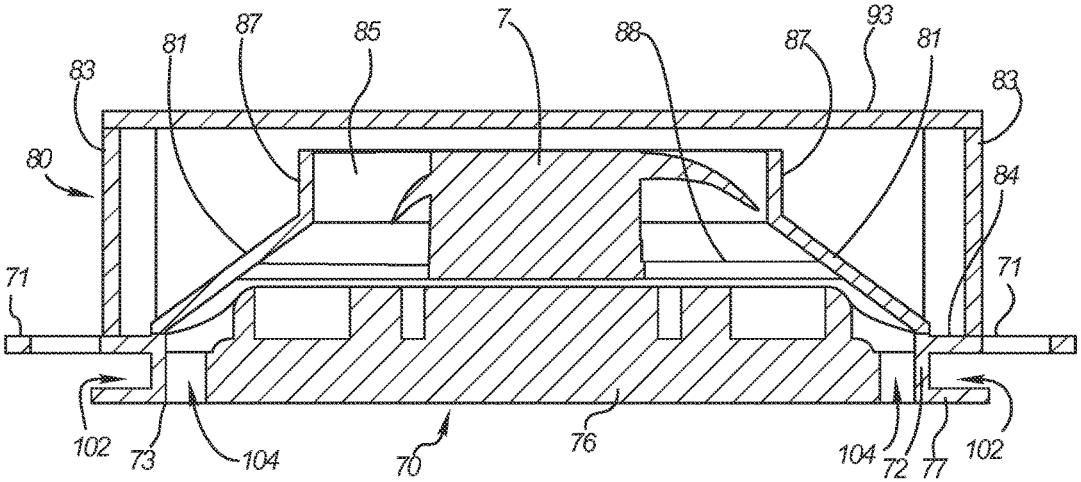
FIG. 7 is a cross sectional view of a second embodiment of a LED cooling system.
Figure 8:
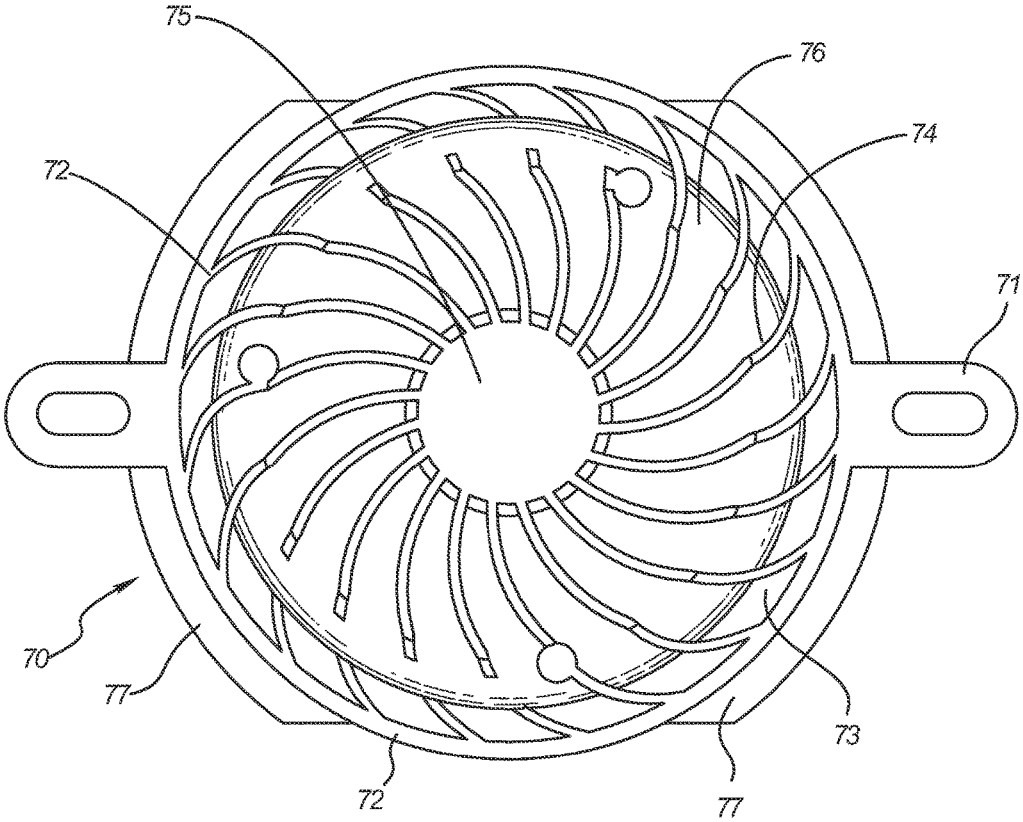
FIG. 8 is a top view of a second embodiment of a heat sink.

As shown in FIG. 6-8, the LED cooling system 200 comprises a heat sink 70. Although the heat sink 70 shown in FIGS. 6 and 8 is substantially circular in shape, embodiments of heat sinks comprises non-circular shapes (such as a rectangle, triangle, and the like) are also contemplated. One or more embodiments of the heat sink 70 comprise a circular platform 76 and a circular sink wall 72 separated by an annular opening 73. An array of ribs 74 may extend from a raised center member 75 on the platform 76 to the sink wall 72, thus bridge the annular opening 73 and coupling the platform 76 to the sink wall 72. In a particular embodiment, such as that shown in FIGS. 6 and 8, the ribs 74 comprise arced ribs 74. Ends of the ribs 74 opposite the raised center member 74 may be configured such that the ribs 74 do not contact the sloped body 81 when the fan housing 80 is coupled to the heat sink 70.

One or more embodiments of the heat sink 70 further comprise at least one sink lip 77 extending from the sink wall 72. In the embodiment shown in FIG. 8, the heat sink 70 comprises two opposing sink lips 77 each extending from the sink wall 72. The sink lips 77 typically extending from a base end of the sink wall 72. Embodiments of the heat sink 70 may further comprise at least one fastener mount 71 also extending from the sink wall 72. In the embodiment shown in FIGS. 6 and 8, the heat sink 70 comprises two opposing fastener mounts 71 positioned proximate the opposing sink lips 77. When positioned proximate one another, a sink lip 77 and a fastener mount 71 are at different heights on the sink wall 72 in some embodiments. For example, while the sink lip 77 may extend from a base end of the sink wall 72, the fastener mount 71 may extend from a top end of the sink wall 72 opposite the base end. In one or more embodiments, the fastener mounts 71 are positioned opposite one another and between the opposing sink lips 77 rather than proximate the opposing sink lips 77. In another embodiment, one or more fastener mounts 71 are positioned on or proximate the platform 76 such that the one or more fastener mounts 71 align with standard J-box housing 50. The heat sink 70 may further comprise one or more mounting holes for mounting the LED 5 to the heat sink 70, or, alternatively, coupling the heat sink 70 to the fan housing 80. The mounting holes are typically positioned on the platform 76.

Figure 9A:
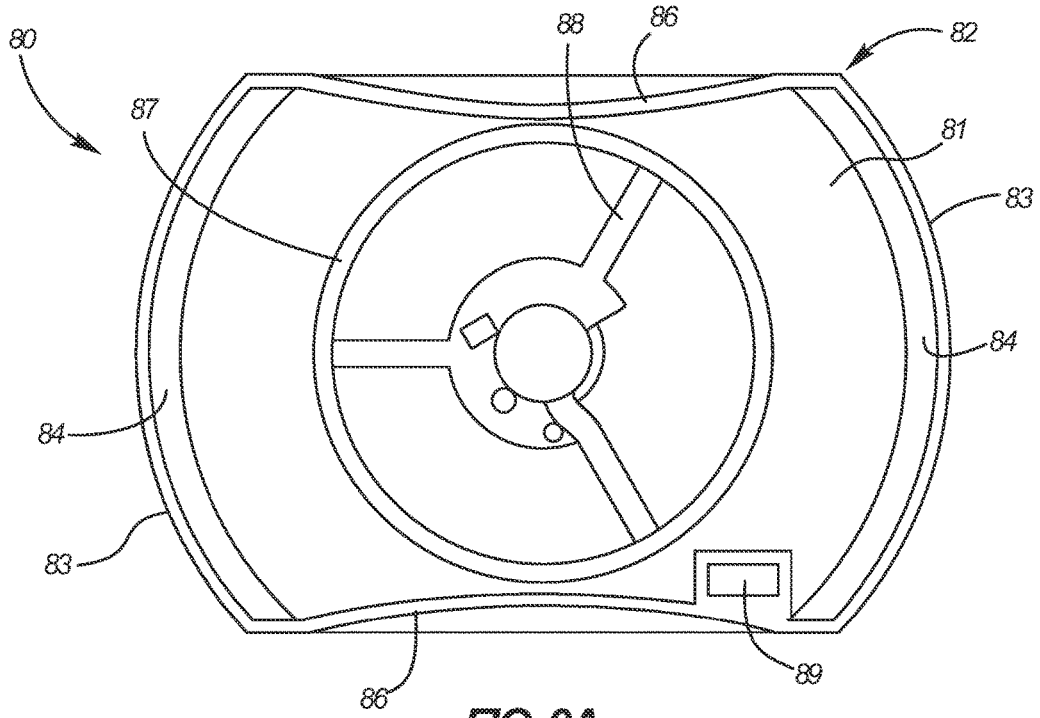
FIG. 9A is a top view of a second embodiment of a fan housing.
Figure 9B:
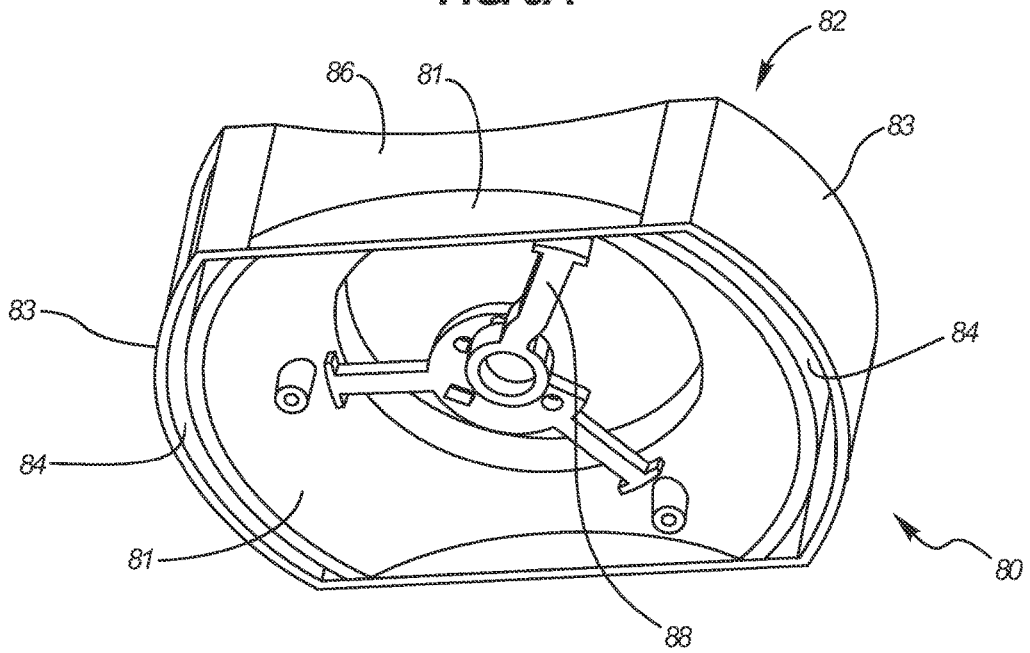
FIG. 9B is a bottom perspective view of a second embodiment of a fan housing.

FIGS. 9A and 9B illustrate top and perspective views, respectively, of an embodiment of a fan housing 80. The fan housing 80 typically comprises a sloped body 81 partially within the fan housing walls 82. The fan housing walls 82, in one or more embodiments, comprise two opposing convex portions 83 and two opposing concave portions positioned between the two opposing convex portions 83. Various embodiments may also include a planar connector wall between each convex portion 83 and concave portion 86.

The sloped body 81 is typically shaped such that the base end of the sloped body 81 complements at least a portion of the sink wall 72. In FIG. 9B, the sloped body 81 comprises a substantially conical sloped body 81. Portions of the based end of the sloped body 81 may be planar, as shown in FIG. 9A. Extending from a top end of the sloped body 81 is a rim 87 in various embodiments. The rim 87 and the sloped body 81 together (or individually) form the boundary of a fan housing aperture extending through the sloped body 81. The fan housing wall 82 typically comprises a height dimension greater than a height dimension of the sloped body 81 (and the rim 87, if included). One or more embodiments of the fan housing 80 further comprise a fan mount 88 coupled to the sloped body 81 or the rim 87 within the fan housing aperture 85. As shown in FIG. 9B, wire slot 89 may also extend through the sloped body 81.

In one or more embodiments, at least one outer opening 84 is positioned between a convex portion 83 of the fan housing wall 82 and a portion of the sloped body 81. In the embodiment shown in FIGS. 9A and 9B, the fan housing 80 comprises two opposing outer openings 84, each outer opening 84 positioned between a different convex portion 83 of the fan housing wall 82 and a different portion of the sloped body 81. Because the height dimension of the sloped body 81 is less than the height dimension of the fan housing wall 82, each outer opening 84 is in fluid communication with the fan housing aperture 85.

FIG. 7 illustrates a partial cross-sectioned view of a LED cooling system 200. Although not shown in FIG. 7, a LED 5 and/or face plate 10 are sometimes coupled to the heat sink 70 below the heat sink 70. As shown in FIG. 7, each opposing concave portion 83 of the fan housing wall 82 abuts or contacts a fastener mount 71. Because the fastener mount 71 and the sink lip 77 extend from the sink wall 72 at different heights, an air intake opening 102 is formed between the sink lip 72 and the fan housing walls 82. The air intake opening 102 is in fluid communication with the outer opening 84 of the fan housing 80, which outer opening is in fluid communication with the fan housing aperture 85.

FIG. 7 further illustrates an air exhaust opening 104 formed by the annular opening 73 of the heat sink 70. The base end of the sloped body 81 abuts the sink wall 72 in one or more embodiments. Thus the air exhaust opening 104 is in fluid communication with the annular opening 73 and the fan housing aperture 85.

Upon activation of the fan 7 within the rim 87 and sloped body 81, external air is drawn from outside the system through the two opposing air intake openings 102, through the outer openings 84 of the fan housing 80 to the fan 7 within the sloped body 81. Rotation of the fan 7 subsequently directs the air towards the platform 76 of the heat sink 70 and ultimately through the two opposing air exhaust openings 104. Inclusion of the two air intake openings 102 and the two air exhaust openings 104 allows for introduction of more external air through the air intake openings 102 followed by exhaustion of hot air from the system through the two air exhaust openings 104 when the fan is activated. Transfer of the external air through the system and blowing of the fan 7 on the platform 76 results in cooling of the system 200 generally and the platform 76 specifically.

Figure 11:
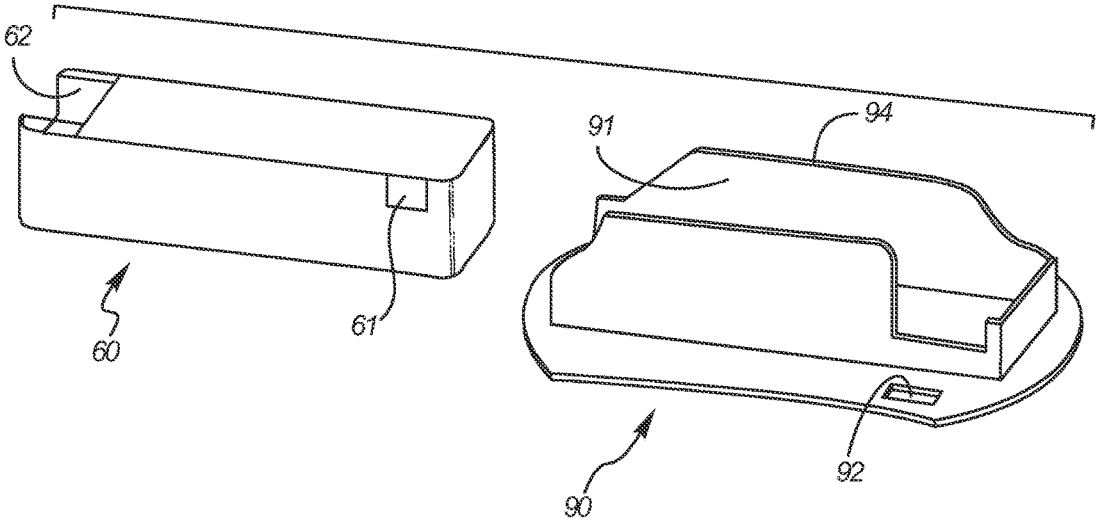
FIG. 11 is a break apart view of a power adapter and Wi-Fi module and a cover.

FIG. 11 illustrates an embodiment of an power adapter 60 and a cover 90. Although not shown with the figures associated with LED cooling system 100, the power adapter 60 shown in FIG. 11 may be utilized in the either LED cooling system 100 or 200. The power adapter typically comprises an AC input 62 and a DC output 61. According to various aspects, the power adapter 60 further comprises a removable wi-fi module 63. The wi-fi module may comprise any wi-fi module known in the art configured for use in the LED cooling system. The wi-fi module 63 is configured to allow a user to control the light functions through a communication network. As shown in FIG. 11, one or more embodiments of a cover 90 comprise an adapter channel positioned between two channel walls 94. The channel walls 94 typically extend from a cover base 93 shaped to align with the fan housing walls 82. Some embodiments of the channel walls 94 comprise arced interior portions that allow for removable coupling of the adapter 60 within the adapter channel 91. A fan wire slot 92 may also extend through the cover base 93 and align with the wire slot 89 of the fan housing 80.

Figure 10:
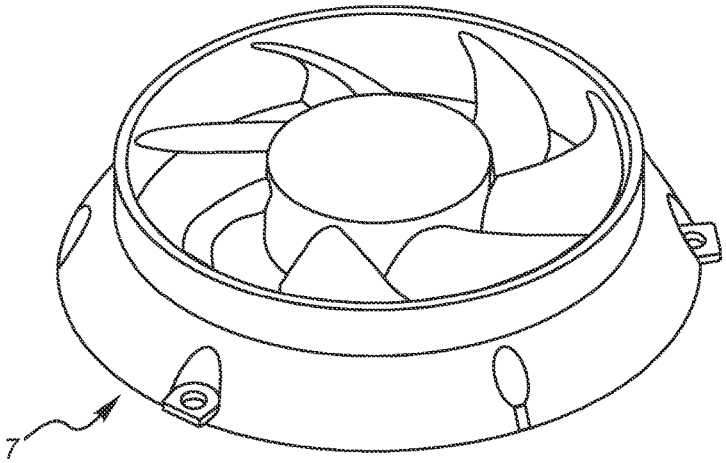
FIG. 10 is a perspective view of a fan.

FIG. 10 illustrates an embodiment of a fan 7 used in various embodiments of LED cooling systems disclosed herein. Any fan sized to fit within the fan housing apertures 35, 85 may be utilized in various embodiments. In particular embodiments, the fan 7 comprises a fan housing shaped to complement the sloped body 31, 81 and the rim 87 of the fan housing 30, 80. One or more embodiments of the fan 7 comprise three blades and four struts. The adapter 60 and/or batteries may provide power to activate the fan 7. In one or more embodiments, the fan 7 is included within the fan housing 30, 80 during assembly, while in other embodiments, the fan 7 may be removably coupled within the fan housing 30, 80 after assembly. The fan 7 may be coupled to the fan housing 30, 80 with any couplings known in the art, such as but not limited to screws, pins, adhesives, magnets, and the like.

It will be understood that implementations are not limited to the specific components disclosed herein, as virtually any components consistent with the intended operation of a method and/or system implementation for LED cooling systems may be utilized. Accordingly, for example, although particular fans, heat sinks, fan housings, LEDs, covers, and the like may be disclosed, such components may comprise any shape, size, style, type, model, version, class, grade, measurement, concentration, material, weight, quantity, and/or the like consistent with the intended operation of a method and/or system implementation for a LED cooling system may be used.

In places where the description above refers to particular implementations of an LED cooling system, it should be readily apparent that a number of modifications may be made without departing from the spirit thereof and that these implementations may be applied to other LED cooling system or assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A light emitting diode (LED) lighting system, comprising:

one or more LEDs;

a heat sink coupled to the one or more LEDs;

a fan housing coupled to the heat sink opposite the one or more LEDs, the fan housing comprising a fan housing aperture extending therethrough;

a fan coupled to the fan housing and positioned at least partially within the fan housing aperture;

a cover coupled to the fan housing opposite the heat sink; and a power adapter electrically coupled to the fan and removably coupled to the cover opposite outside the fan housing between opposing cover walls;

wherein the fan housing further comprises a fan mount positioned within a sloped body at least partially surrounding the fan housing aperture, and a cylindrical rim on an end of the sloped body.

2. The LED lighting system of claim 1, wherein the heat sink comprises a platform, a sink wall at least partially surrounding the platform, and an annular opening positioned between the platform and the sink wall and in fluid communication with the fan housing aperture.

3. The LED lighting system of claim 2, wherein the heat sink further comprises:

a raised center member protruding from the platform toward the fan housing;

an array of ribs extending from the raised center member across the annular opening to the sink wall;

at least one sink lip extending outwardly from the sink wall; and at least one fastener mount extending from the sink wall proximate the at least one sink lip.

4. The LED lighting system of claim 3, wherein the sloped body abutting the sink wall, a fan housing wall coupled to the sloped body, and at least one outer opening positioned between the sloped body and the fan housing wall.

5. The LED lighting system of claim 4, wherein the sloped wall is substantially conical and the fan housing wall comprises two opposing concave portions that intersect the sloped body and two opposing convex portions, and the at least one intake opening comprises two intake openings each positioned between the sloped body and a different convex portion of the opposing convex portions.

6. The LED lighting system of claim 5, wherein the at least one sink lip comprises two opposing sink lips and the at least one fastener mount comprises two opposing fastener mounts, each fastener mount extending from the sink wall proximate a different sink lip, the two opposing convex portions of the fan housing wall being aligned with the two opposing sink lips and adjacent to the two opposing fastener mounts such that an intake opening that is in fluid communication with the outer opening of the fan housing and the fan housing aperture is formed between each convex portion and each sink lip.

7. The LED lighting system of claim 1, further comprising a J-box coupled to the LED and at least partially housing the heat sink, the fan housing, and the cover, and wherein the adapter further comprises a removable wi-fi module.

8. The LED lighting system of claim 1, wherein the fan housing, the fan, the cover and at least a portion of the heat sink are sized to fit within a junction box having a depth that is no greater than 3 inches.

9. The LED lighting system of claim 1, wherein the adapter comprises an AC input and a DC output.

10. The LED lighting system of claim 1, wherein the adapter comprises an AC input.

11. A light emitting diode (LED) cooling assembly, comprising:

a heat sink;

a fan housing coupled to the heat sink, the fan housing comprising a fan housing aperture extending therethrough;

a fan coupled to the fan housing and positioned at least partially within the fan housing aperture;

a fan housing cover coupled to the fan housing opposite the heat sink; and a power adapter removably coupled to the fan housing cover opposite the fan housing, the power adapter seated against an outer surface of the fan housing cover between at least two opposing walls of the fan housing cover extending in a direction away from the fan housing.

12. The LED cooling assembly of claim 11, wherein the heat sink comprises a platform, a sink wall at least partially surrounding the platform, and an annular opening positioned between the platform and the sink wall and in fluid communication with the fan housing aperture, and wherein the fan housing, the fan, and the heat sink are sized to fit within a junction box having a depth that is no greater than 3 inches.

13. The LED cooling assembly of claim 12, wherein the heat sink further comprises:

a raised center member protruding from the platform toward the fan housing;

an array of arced ribs extending from the raised center member across the annular opening to the sink wall;

two opposing sink lips extending outwardly from the sink wall; and two fastener mounts extending from the sink wall each proximate a different sink lip of the two sink lips.

14. The LED cooling assembly of claim 13, wherein the fan housing comprises a sloped body at least partially surrounding the fan housing aperture and abutting the sink wall, a fan housing wall coupled to the sloped body, and at least one outer opening positioned between the sloped body and the fan housing wall.

15. The LED cooling assembly of claim 14, wherein:

the fan housing wall comprises two opposing concave portions that intersect the sloped body and two opposing convex portions;

the at least one intake opening comprises two intake openings each positioned between the sloped body and a different convex portion of the opposing convex portions; and the two opposing convex portions of the fan housing wall are aligned with the two opposing sink lips and adjacent to the two opposing fastener mounts such that an intake opening that is in fluid communication with the outer opening of the fan housing and the fan housing aperture is formed between each convex portion and each sink lip.

16. The LED cooling assembly of claim 11, wherein the adapter comprises an AC input and a DC output.

* * * * *